US007356983B2

(12) United States Patent
Bieszczad et al.

(10) Patent No.: US 7,356,983 B2
(45) Date of Patent: Apr. 15, 2008

(54) SPIRALING APPARATUS

(75) Inventors: Paul A. Bieszczad, Perrysburg, OH (US); John R. Huckaby, Jr., Bowling Green, OH (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/133,604

(22) Filed: May 20, 2005

(65) Prior Publication Data

US 2007/0095042 A1 May 3, 2007

(51) Int. Cl.
*D02G 3/36* (2006.01)

(52) U.S. Cl. ..... 57/17; 57/18

(58) Field of Classification Search ..... 57/10, 57/11, 13, 14, 17, 18, 65
See application file for complete search history.

(56) References Cited

U.S. PATENT DOCUMENTS 2,802,328 A * 8/1957 Ritchie ..... 57/13
3,448,569 A * 6/1969 Rose et al. ..... 57/15
4,142,352 A * 3/1979 Greczin ..... 57/15
4,161,903 A * 7/1979 Sokol ..... 87/57
4,555,898 A * 12/1985 Canivet ..... 57/19
5,765,357 A * 6/1998 Burgess et al. ..... 57/311
5,979,288 A * 11/1999 Gallagher et al. ..... 87/36

* cited by examiner

*Primary Examiner*—Shaun R. Hurley
(74) *Attorney, Agent, or Firm*—Benesch, Friedlander Coplan & Aronoff LLP

(57) ABSTRACT

A spiraling apparatus is provided that includes a rotatable deck having a deck plate that includes first and second sides. A plurality of first spools are rotatably attached to the first side of the deck plate. The first spools include a length of reinforcement wound thereon. A plurality of second spools are rotatably attached to the second side of the deck plate. The second spools also include a length of reinforcement wound thereon. A tension regulating device is adapted to regulate tension in the reinforcement as the reinforcement is removed from the first and second spools during rotation of the deck.

17 Claims, 7 Drawing Sheets

SPIRALING APPARATUS

BACKGROUND OF THE INVENTION

1. Field of the Invention

The present invention relates to spiraling apparatus suitable for applying reinforcement onto a work-piece, such as a hose or cable.

2. Description of the Related Art

Machines that apply spiral wound reinforcement to a work-piece, such as a hose or cable, typically include a number of reinforcement supply bobbins. Each bobbin includes reinforcement, such as textile or wire, which is wound onto the supply bobbin from a supply of bulk reinforcement provided by the reinforcement manufacturer. While spiral machines of the type described above have been used effectively, the use of conventional spiral machine supply bobbins is generally inefficient. Among other inefficiencies, a hose or cable manufacturer must purchase auxiliary reinforcement winding equipment to transfer the bulk reinforcement to the spiral machine's supply bobbins, in addition to purchasing the spiraling machine itself. Furthermore, the relatively small capacity supply bobbins, particularly when compared to the capacity of bulk reinforcement spools, force the hose or cable manufacturer to frequently reload the spiral machine with fresh supply bobbins-an exercise that greatly increases spiral machine downtime or inefficiency. For at least these reasons, there is a need for improved spiraling apparatus that reduce, among other things, machine downtime associated with the use of conventional spiral machine supply bobbins.

SUMMARY OF THE INVENTION

A spiraling apparatus is provided for applying reinforcement onto a work-piece, such as a hose or cable. In an embodiment, the spiraling apparatus includes a rotatable deck having a deck plate that includes first and second sides. A plurality of first spools are rotatably attached to the first side of the deck plate. The first spools include a length of reinforcement wound thereon. A plurality of second spools are rotatably attached to the second side of the deck plate. The second spools also include a length of reinforcement wound thereon. A tension regulating device is adapted to regulate tension in the reinforcement as the reinforcement is removed from the first and second spools during rotation of the deck.

Other aspects of the invention will be apparent to those skilled in the art after review of the drawings and detailed description provided below.

BRIEF DESCRIPTION OF THE DRAWINGS

Embodiments of the invention will now be described, by way of example, with reference to the accompanying drawings, wherein.

DETAILED DESCRIPTION

Figure 1:
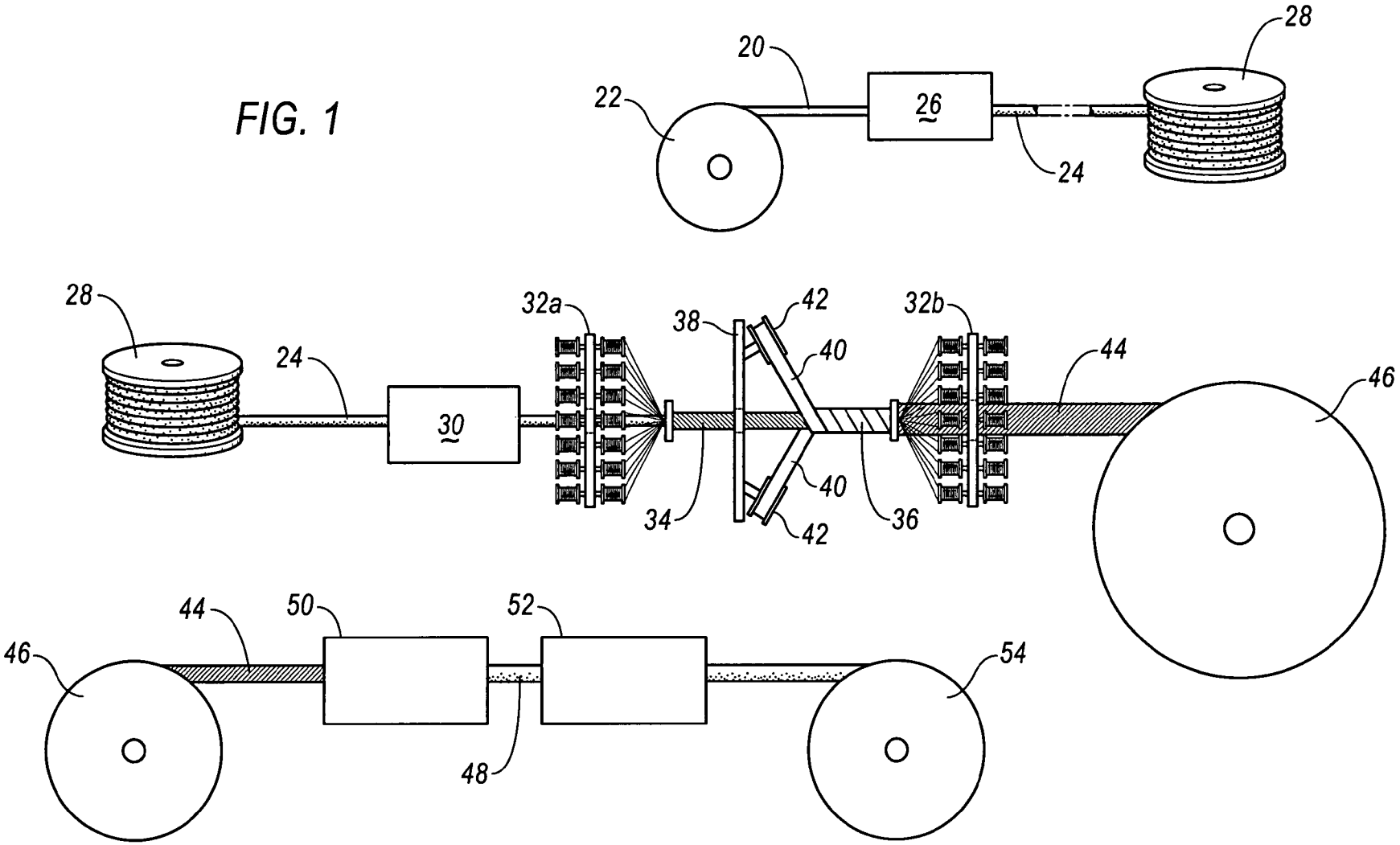
FIG. 1 is an exemplary sequence of operations for manufacturing a work-piece, such as a wire-reinforced hose, using a spiraling apparatus according to the present invention.

To provide environmental perspective, an exemplary sequence of operations for manufacturing a flexible, high-pressure, wire-reinforced hose using a spiraling apparatus according to the present invention is shown in FIG. 1. To begin, a flexible mandrel 20 is manufactured and wound onto a spool 22. Mandrel 20 may be coated with a suitable lubricant, which serves as a parting agent to prevent the finished hose from sticking to mandrel 20 after manufacture. An polymeric inner tube or layer of unvulcanized rubber or plastic 24 is extruded over mandrel 20 by means of a cross-head extruder 26 and wound onto a reel 28 or fed directly to the next operation described below.

The polymeric layer 24 and supporting mandrel 20 are then unreeled from reel 28 (or fed directly from extruder 26) and passed through an optional low-temperature chamber 30 to stiffen the polymeric tube if needed. The polymeric layer 24 and mandrel 20 emerge from chamber 30 and are immediately passed through a first spiraling apparatus 32*a* that applies a spiral-wound reinforcement layer 34, such as layer of brass coated steel wire, over polymeric layer 24. In an elastomeric hose construction, for example, a thin layer 36 of uncured elastomer may be wrapped about spiral layer 34 by means of a spiral wrapping device 38 carrying strips 40 of the elastomer on reels 42. Thereafter, a second spiral-wound reinforcement layer 44 is applied by a second spiraling apparatus 32*b* that is substantially similar to first spiraling apparatus 32*a*, but rotating in an opposite direction relative to the hose structure. Although the exemplary operation is shown as having two spiraling apparatus 32, the operation is not necessarily limited thereto.

The resulting hose structure may then be coiled onto a reel 46 and is ready for a finishing operation, such as applying a polymeric cover layer 48 over the reinforcement layers using a cross-head extruder 50, or the hose structure may pass directly from second spiraling apparatus 32*b* into extruder 50 without being wound onto reel 46. Thereafter, the hose structure is passed through a steam vulcanization chamber 52, if required, wherein the elastomeric layers are vulcanized, and the hose structure is coiled onto a reel 54. Alternatively, the hose structure may be coiled onto reel 54 after extruding cover layer 48 and then vulcanized.

Figure 2:
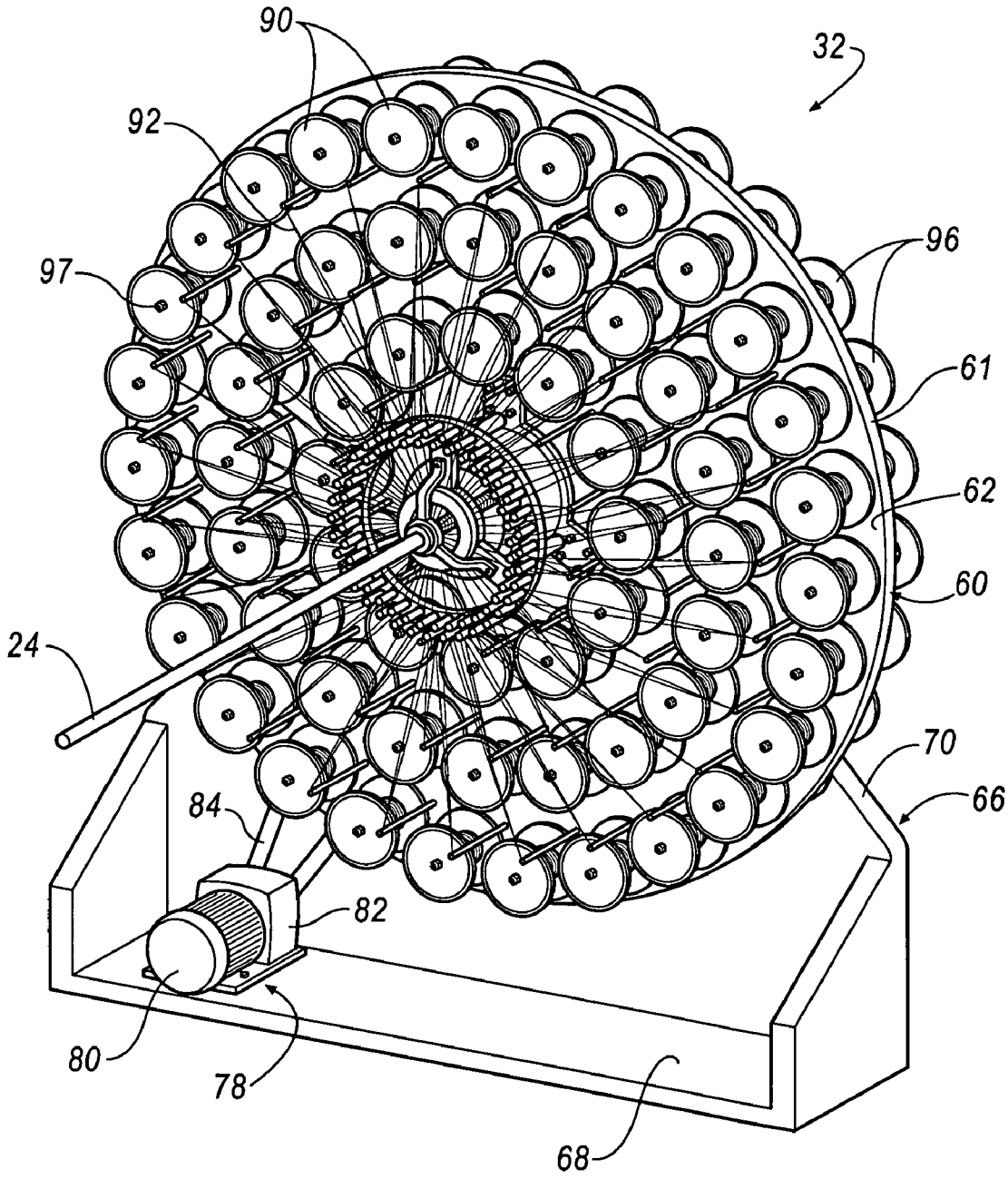
FIG. 2 is a perspective view of a spiraling apparatus according to an embodiment of the present invention.
Figure 4:
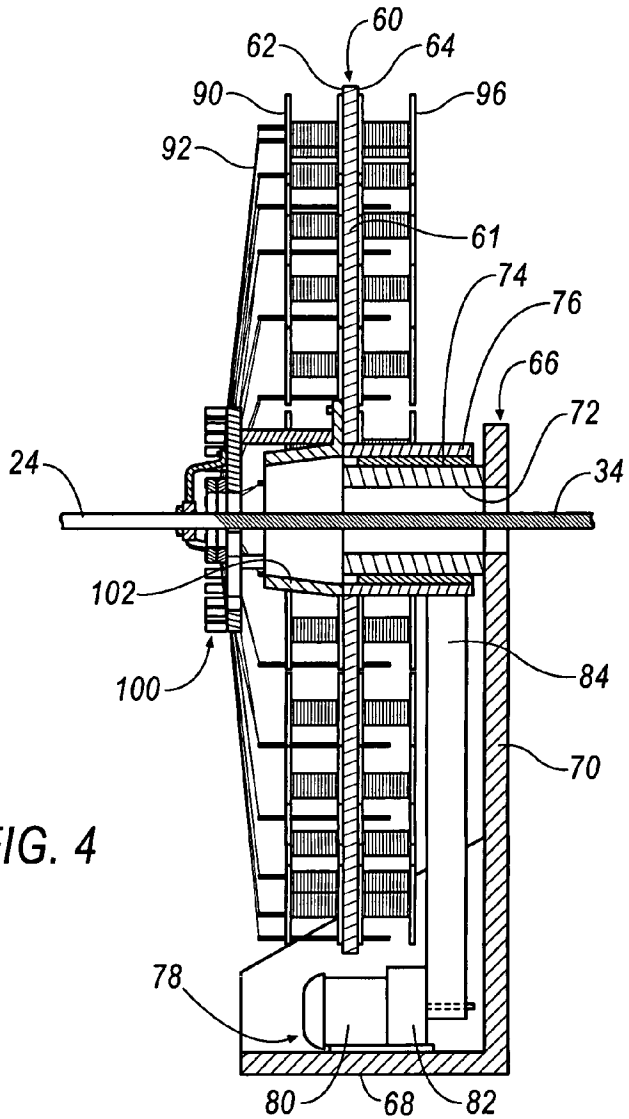
FIG. 4 is a cross-sectional view of the spiraling apparatus of FIG. 2.
Figure 3:
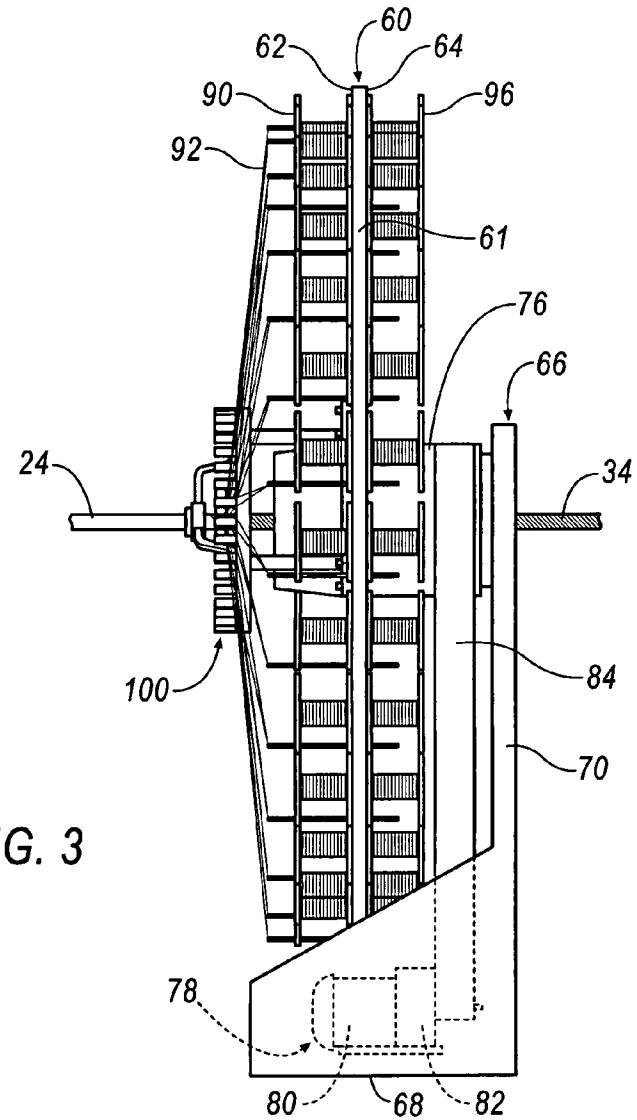
FIG. 3 is a side elevation view of the spiraling apparatus of FIG. 2.
Figure 6:
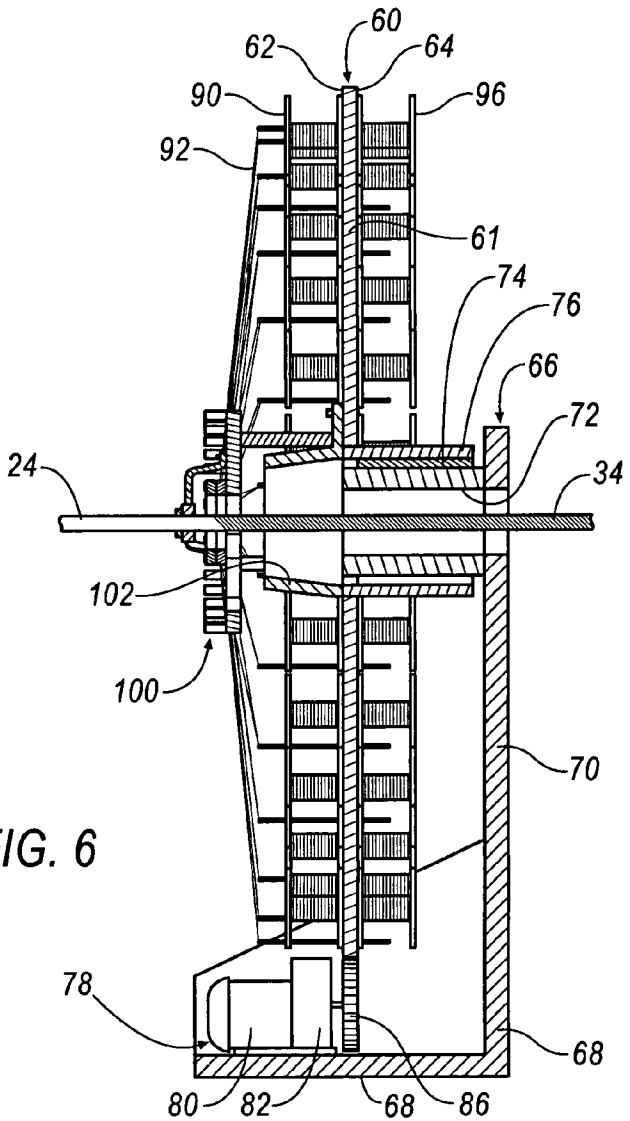
FIG. 6 is a cross-sectional view of the spiraling apparatus of FIG. 5.
Figure 5:
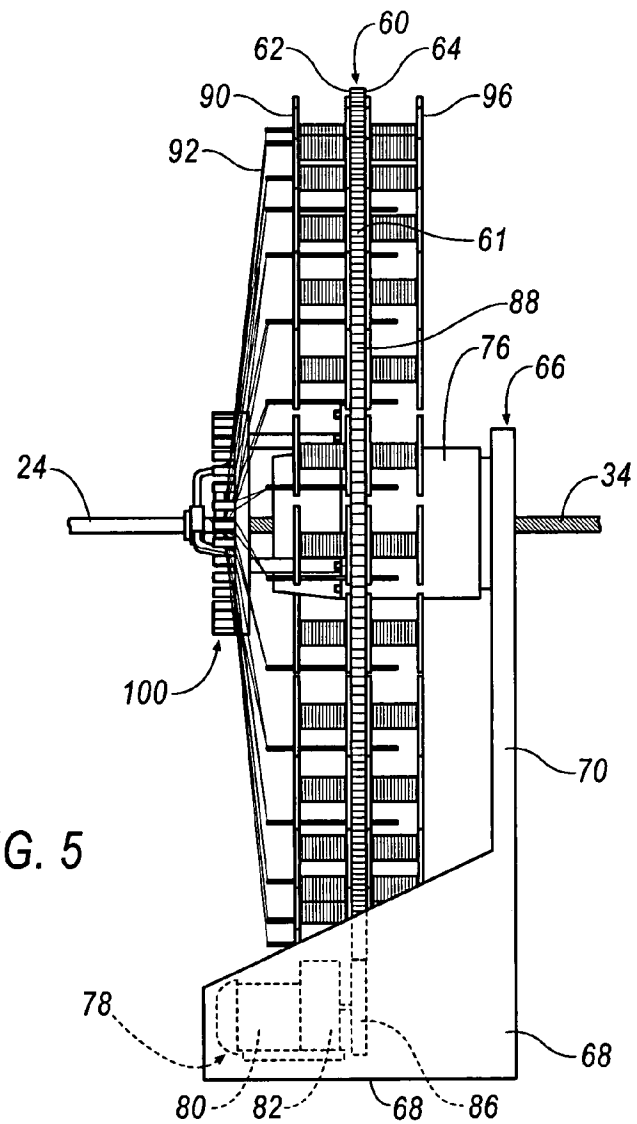
FIG. 5 is a side elevation view of a spiraling apparatus according to another embodiment of the present invention.

Referring to FIGS. 2-4, a spiraling apparatus 32 according to an embodiment of the present invention is shown. In the illustrated embodiment, spiraling apparatus 32 includes a rotatable deck 60 having a deck plate 61 with first and second sides 62 and 64. The generally donut-shaped deck plate 61, which may be made of steel or other structural material, is rotatably supported by a frame 66 that includes a base 68 and a support flange 70 having a deck support 72 cantilevered over base 68. A bearing 74 (shown in FIG. 4) is positioned between deck support 72 and a generally cylindrical deck shaft 76 that is secured or connected to deck plate 61. Bearing 74 facilitates rotation of deck 60 relative to frame 66, particularly at relatively high speeds (e.g., 120 rpm). The components for supporting deck 60 are not limited to the frame configuration described above and shown in the drawings, and may include other support structures, such as, for example, a bearing saddle that supports deck 60 along its lower edge (not shown).

In an embodiment, deck 60 is rotated using a drive assembly 78 that includes an electric motor 80, a transmission mechanism or gearbox 82 and a belt or chain 84 adapted to engage and rotate deck shaft 76. Deck 60 may be equipped with an optional brake (not shown), such as a pneumatically operated brake, to quickly stop rotation of deck 60 in the event of an emergency. The components for rotating deck 60 or stopping its rotation are not intended to be limited to the configuration shown in FIGS. 2-4, and it will be appreciated that other components and configurations may be used to control rotation of deck 60 without departing from the spirit and scope of the present invention. For example, in another embodiment of the present invention shown in FIGS. 7 and 8, drive assembly 78 may include a gear 86, in lieu of belt or chain 84, for direct driving engagement of deck plate 61 through a splined interface 88.

Figure 7:
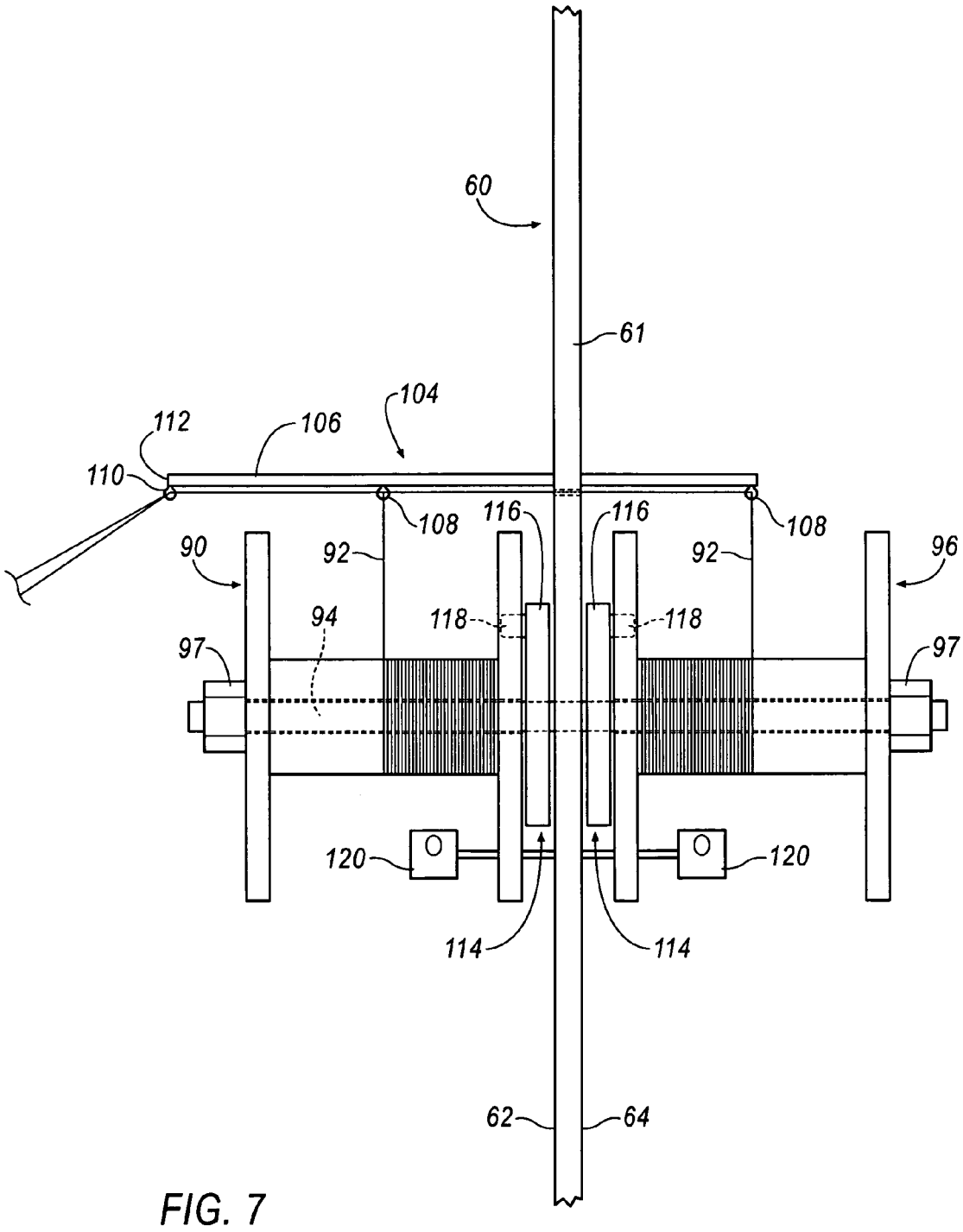
FIG. 7 is a detailed view of a spiraling apparatus according to an embodiment of the present invention, showing the first and second spools.
Figure 8:
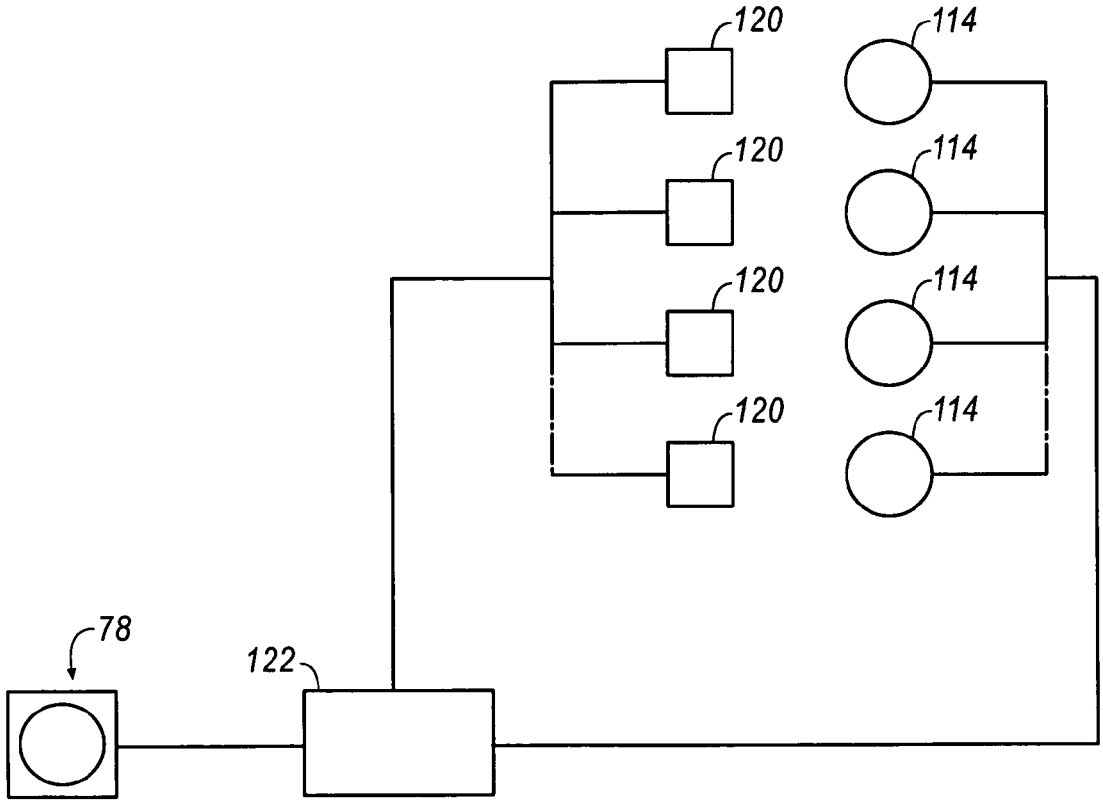
FIG. 8 is a schematic illustration of a spiraling apparatus control system according to an embodiment of the present invention.
Figure 9:
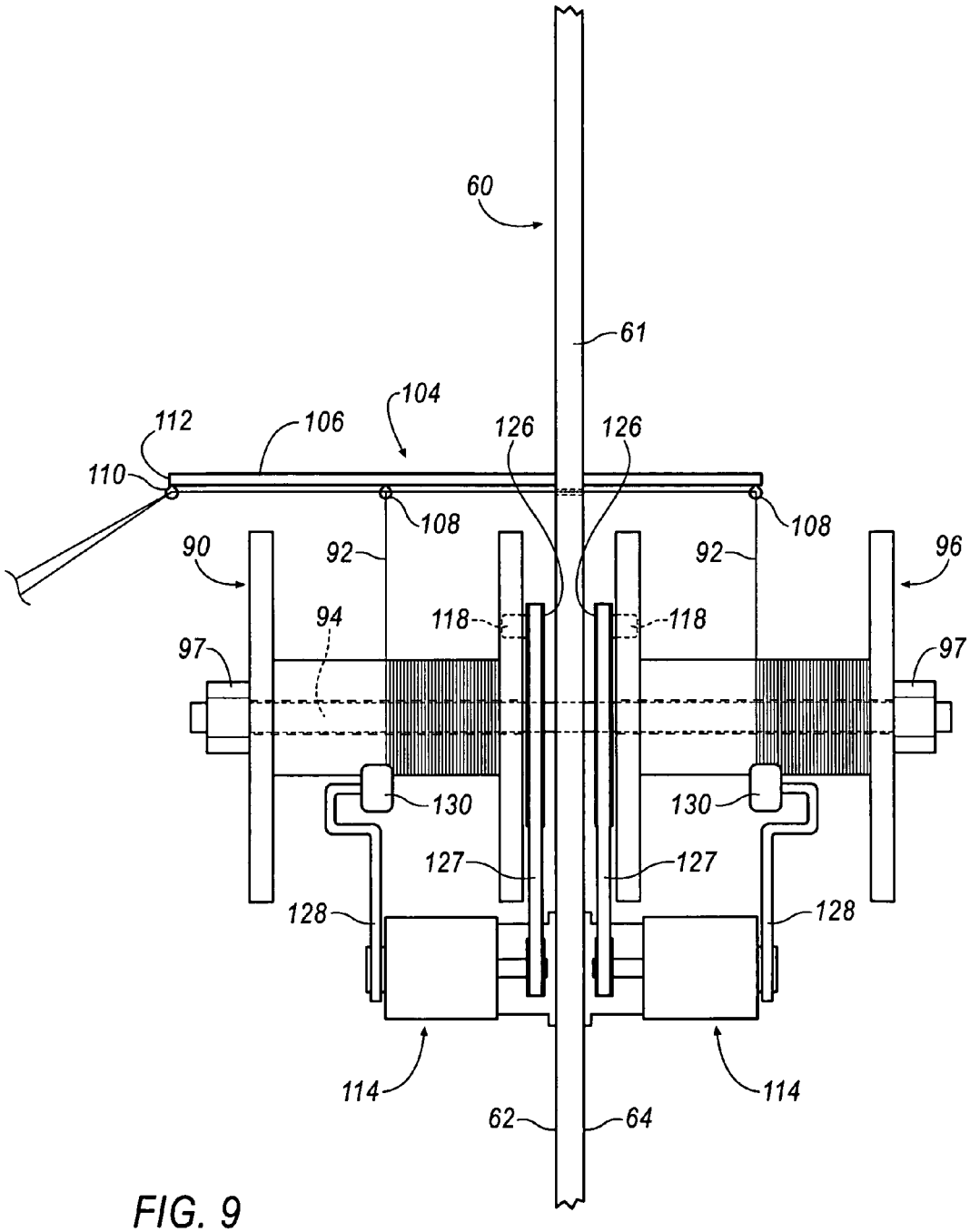
FIG. 9 is a detailed view of a spiraling apparatus according to another embodiment of the present invention, showing the first and second spools.

A plurality of first spools 90, each including reinforcement 92 wound thereon, are rotatably supported on first side 62 of deck plate 61 by a generally cylindrical support member 94 (see, e.g., FIGS. 7 and 9). Similarly, a plurality of second spools 96, each including reinforcement 92 wound thereon, are rotatably supported on second side 64 of deck plate 61 by support member 94. When so configured, each second spool 96 on second side 64 includes a corresponding first spool 90 on first side 62. Spools 90, 96 may be retained on support member 94 using a collar 97, such as a threaded nut or quick-connect coupler. The placement of spools 90, 96 on each of first and second sides 62, 64 minimizes the diameter of deck plate 61 and more evenly distributes the centrifugal load imposed on deck plate 61 by spools 90, 96.

In an embodiment, first and second spools 90, 96 comprise bulk reinforcement spools supplied by the reinforcement manufacturer. In the case of wire reinforcement, for example, such spools are typically supplied with 60 lbs (27 kg) of wire. The use of bulk reinforcement spools eliminates the secondary winding operation that transfers bulk reinforcement from the reinforcement manufacturer supplied spools to smaller bobbins.

In an embodiment, spiraling apparatus 32 also includes a reinforcement applicator 100 secured for rotation with deck 60 and positioned to apply reinforcement 92 onto hose tube 24 as the reinforcement is drawn from first and second spools 90, 96. In the illustrated embodiment, reinforcement applicator 100 is supported on deck 60 by a generally conical support member 102 having a opening through which the hose structure 34 passes. Reinforcement applicator 100 functions as a guide for precisely positioning reinforcement 92 over the work-piece in a generally spiral pattern as deck 60 rotates about hose tube 24. Various reinforcement applicators suitable for use in spiraling apparatus 32 are well known in the art, particularly the art of spiral hose manufacturing, and will not be further described herein.

Spiraling apparatus 32 may also include a reinforcement distribution member 104 adapted to facilitate distribution of reinforcement 92 from first and second spools 90, 96 to reinforcement applicator 100. In an embodiment shown in FIGS. 7 and 9, for example, reinforcement distribution member 104 includes a rigid arm 106 that extends generally perpendicular to deck 60 adjacent corresponding first and second spools 90, 96. Arm 106 may include a pair of first eyelets 108 through which reinforcement from spools 90, 96 extends as reinforcement 92 is drawn therefrom. A second eyelet 110 may be positioned proximate a distal end 112 of arm 106 that extend a beyond the spool 90 closest to reinforcement applicator 100. First and second eyelets 108, 110 facilitate a directional change in reinforcement 92 without imposing undue stress in the reinforcement material.

Referring still to FIGS. 7 and 9, spiraling apparatus 32 may also include a tension regulating device 114 adapted to regulate reinforcement tension as reinforcement 92 is removed from first and second spools 90, 96 during rotation of deck 60. In the embodiment shown in FIG. 2, for example, each spool 90, 96 is positioned within one of three concentric rings of adjacent spools; however, the number of rings or individual spools within a ring will depend on a particular application and is not intended to be limited to the configuration shown in the drawing. In any given spool configuration, the amount of tension in a spool's reinforcement may depend on, among other things, the spool's location relative to reinforcement distribution member 104 and the rotational speed of deck 60. For example, spools in a radially outer ring may have more or less reinforcement tension than a spool in a radially inner ring. Tension regulating device 114 maintains a predetermined reinforcement tension in a spool regardless of the spool's location or rotational speed of deck 60.

In an embodiment, tension regulating device 114 may be configured to regulate reinforcement tension by regulating rotation of first and second spools 90, 96. In the configuration illustrated in FIG. 7, for example, tension regulating device 114 may include a brake or a clutch 116 (generically shown in FIG. 7), which includes a first portion non-rotatably secured to support member 94 and/or deck 60 and a second portion rotatable relative to support member 94 and/or deck 60. A tab 118 may be used to secure the rotation portion of tension regulating device 114 to spool 90, 96. When configured as a clutch or brake, tension regulating device 114 functions to selectively resist rotation of spool 90, 96 and, in doing so, increase the tension in reinforcement 92. This feature is particularly useful when spool 90, 96 is rotating faster than the reinforcement is being drawn therefrom.

Spiraling apparatus 32 may also include a control system for controlling its operation. In an embodiment, the control system includes a sensor 120, such as a laser operated distance sensor, to monitor the amount of reinforcement remaining on spools 90, 96 and provide a signal to a controller 122 (see, e.g. FIG. 8) indicative of this amount. Controller 122 is configured to control tension in reinforcement 92 through operation of tension regulating device 114 based on, among other things, the amount of reinforcement remaining on a spool and the spool location on deck 60 (e.g., whether it is in the first, second or third ring). Alternatively, tension regulating device 114 may include a load sensor (not shown) that provides a signal to controller 122 indicative of the amount of torque applied to spool 90, 96 as its reinforcement is removed. When so configured, controller 122 controls tension in reinforcement 92 through operation of tension regulating device 114 based on, among other things, the amount of torque being applied to spools 90, 96 and the spool location on deck 60. Controller 122 may communicate with motor assembly 78, reinforcement tension regulating device 114, and sensors 120 through a wired connection or a wireless connection (e.g., Bluetooth or WiFi).

In another configuration shown in FIG. 9, tension regulating device 114 includes a remotely mounted brake or clutch 124 connected to a spool-supporting flywheel 126 by a belt or chain 127. A pivot arm 128 with a rotating wheel end 130 that rides on reinforcement 92 may be movably attached to tension regulating device 114 to provide an input indicative of the amount of reinforcement remaining on spools 90, 96. Alternatively, as described above, a laser operated distance sensor may be provided in lieu of pivot arm 128 to monitor the amount of reinforcement remaining on spools 90 and 96, or a load sensor may be used to provide a signal to controller 122 indicative of the amount of torque applied to spool 90, 96.

The present invention, while suitable for manufacturing hose as described above in the exemplary manufacturing sequence, may be used in the manufacture of other products that require the application of reinforcement in a spiral pattern, including but not limited electrical power and communication cables.

The present invention has been particularly shown and described with reference to the foregoing embodiments, which are merely illustrative of the best modes for carrying out the invention. It should be understood by those skilled in the art that various alternatives to the embodiments of the invention described herein may be employed in practicing the invention without departing from the spirit and scope of the invention as defined in the following claims. It is intended that the following claims define the scope of the invention and that the method and apparatus within the scope of these claims and their equivalents be covered thereby. This description of the invention should be understood to include all novel and non-obvious combinations of elements described herein, and claims may be presented in this or a later application to any novel and non-obvious combination of these elements. Moreover, the foregoing embodiments are illustrative, and no single feature or element is essential to all possible combinations that may be claimed in this or a later application.

What is claimed is:

1. A spiraling apparatus for applying reinforcement, comprising:

a rotatable deck having a deck plate that includes first and second sides;

a plurality of first spools rotatably attached to the first side of the deck plate, the first spools including a reinforcement wound thereon;

a plurality of second spools rotatably attached to the second side of the deck plate, the second spools including reinforcement wound thereon;

a tension regulating device adapted to regulate tension in the reinforcement as the reinforcement is removed from the first and second spools during rotation of the deck; and a control system for controlling operation of the spiraling apparatus, the control system including a sensor and a controller, the sensor configured to monitor an operating parameter of the first and second spools and to provide a signal indicative of the monitored parameter, the controller configured to receive the signal from the sensor and to regulate tension in the reinforcement through operation of the tension regulating device based on the monitored operating parameter of the first and second spools.

2. The apparatus of claim 1, further including a drive assembly adapted to rotate the deck.

3. The apparatus of claim 2, wherein the drive assembly includes a motor, a transmission mechanism and a belt or chain adapted to engage and rotate the deck.

4. The apparatus of claim 2, wherein the drive assembly includes a motor, a transmission mechanism and a gear adapted to engage and rotate the deck.

5. The apparatus of claim 1, wherein the first and second spools are bulk reinforcement spools wound by the reinforcement manufacturer.

6. The apparatus of claim 1, wherein the first and second spools are rotatably supported on the deck by a support member and secured on the support member with a collar.

7. The apparatus of claim 1, further including a reinforcement applicator secured for rotation with the deck and positioned to apply the reinforcement onto a work-piece as the reinforcement is removed from the first and second spools.

8. The apparatus of claim 7, further including a reinforcement distribution member adapted to facilitate distribution of the reinforcement from the first and second spools to the reinforcement applicator without imposing undue stress in the reinforcement.

9. The apparatus of claim 8, wherein the reinforcement distribution member includes an arm that extends generally perpendicular to the deck adjacent the first and second spools, the arm including eyelets through which reinforcement from the first and second spools extends as the reinforcement is removed therefrom.

10. The apparatus of claim 1, wherein the tension regulating device is one of a brake and a clutch.

11. The apparatus of claim 1, wherein the monitored operating parameter is the amount of reinforcement remaining on a spool and the controller is configured to regulate tension in the reinforcement through operation of the tension regulating device based on the amount of reinforcement remaining on the spool.

12. The apparatus of claim 1, wherein the monitored operating parameter is the amount of torque applied to a spool by removal of its reinforcement and the controller is configured to regulate tension in the reinforcement through operation of the tension regulating device based on the amount of torque applied to the spool.

13. The apparatus of claim 1, wherein the tension regulating device is connected to a spool supporting flywheel by a belt or chain.

14. The apparatus of claim 1, wherein the tension regulating device includes a pivot arm with a rotating wheel end that rides on the reinforcement, the pivot arm adapted to provide the tension regulating device with an input indicative of the amount of reinforcement remaining on a spool.

15. A spiraling apparatus for applying reinforcement on a work-piece, comprising:

a rotatable deck having first and second sides and a plurality of support members that extend from each of the first and second sides;

a plurality of first spools including a length of reinforcement wound thereon, each of the first spools supported on the first side of the deck by a support member for rotation relative to the deck;

a plurality of second spools including a length of reinforcement wound thereon, each of the second spools supported on the second side of the deck by a support member for rotation relative to the deck; wherein each of the second spools on the second side includes a corresponding first spool on the first side;

a reinforcement applicator secured for rotation with the deck and positioned to facilitate application of the reinforcement onto the work-piece as the reinforcement is removed from the first and second spools;

a reinforcement distribution member adapted to facilitate distribution of the reinforcement from corresponding first and second spools to the reinforcement applicator without imposing undue stress in the reinforcement; and a tension regulating device adapted to regulate rotation of the first and second spools so that the reinforcement tension is regulated during rotation of the deck.

16. A spiraling apparatus for applying reinforcement, comprising:

a rotatable deck having first and second sides;

a plurality of first spools rotatably attached to the first side of the deck, the first spools including reinforcement wound thereon;

a plurality of second spools rotatably attached to the second side of the deck, the second spools including reinforcement wound thereon;

means for regulating tension in the reinforcement as the reinforcement is removed from the first and second spools during rotation of the deck; and means for controlling operation of the spiraling apparatus.

17. The apparatus of claim 16, wherein the means for regulating tension in the reinforcement is one of a brake and a clutch.

* * * * *